US006093232A

United States Patent [19]

Sheinberg

[11] Patent Number: 6,093,232

[45] Date of Patent: Jul. 25, 2000

[54] IRON-CARBON COMPACTS AND PROCESS FOR MAKING THEM

[75] Inventor: Haskell Sheinberg, Santa Fe, N. Mex.

[73] Assignee: The Regents of the University of California, Los Alamos, N. Mex.

[21] Appl. No.: 09/265,313

[22] Filed: Mar. 9, 1999

[51] Int. Cl.[7] ..... B22F 3/12

[52] U.S. Cl. ..... 75/243; 75/246; 419/11; 419/35; 419/37; 419/54; 419/55

[58] Field of Search ..... 419/11, 35, 37, 419/54, 55; 75/243, 246

[56] References Cited

U.S. PATENT DOCUMENTS

| | | | |
|---|---|---|---|
| 3,124,625 | 3/1964 | Sheinberg et al. | 264/21 |
| 3,201,330 | 8/1965 | Price | 202/26 |
| 3,531,248 | 9/1970 | Sheinberg | 23/209.1 |
| 3,907,706 | 9/1975 | Robins et al. | 252/431 C |
| 4,202,689 | 5/1980 | Ohno et al. | 75/211 |
| 4,486,641 | 12/1984 | Ruffini | 210/10.79 |
| 4,504,441 | 3/1985 | Kuyper | 419/35 |
| 4,776,980 | 10/1988 | Ruffini | 252/513 |
| 5,059,387 | 10/1991 | Brasel | 419/23 |
| 5,328,657 | 7/1994 | Kamel et al. | 419/36 |
| 5,418,069 | 5/1995 | Learman | 428/551 |
| 5,418,811 | 5/1995 | Ruffini et al. | 373/152 |
| 5,460,651 | 10/1995 | Flinchum et al. | 118/419 |
| 5,529,747 | 6/1996 | Learman | 419/62 |
| 5,588,019 | 12/1996 | Ruffini et al. | 373/152 |
| 5,840,785 | 11/1998 | Allen et al. | 523/145 |

*Primary Examiner*—Daniel J. Jenkins
*Attorney, Agent, or Firm*—Samuel L. Borkowsky

[57] ABSTRACT

The present invention includes iron-carbon compacts and a process for making them. The process includes preparing a slurry comprising iron powder, furfuryl alcohol, and a polymerization catalyst for initiating the polymerization of the furfuryl alcohol into a resin, and heating the slurry to convert the alcohol into the resin. The resulting mixture is pressed into a green body and heated to form the iron-carbon compact. The compact can be used as, or machined into, a magnetic flux concentrator for an induction heating apparatus.

52 Claims, No Drawings

IRON-CARBON COMPACTS AND PROCESS FOR MAKING THEM

This invention was made with government support under Contract No. W-7405-ENG-36 awarded by the U.S. Department of Energy to The Regents of the University of California. The U.S. government has certain rights in the invention.

FIELD OF THE INVENTION

The present invention relates generally to iron-carbon compacts and to a process for making them, and more particularly, to iron carbon compacts that can be used as, or machined into, magnetic flux concentrators for an induction heating apparatus.

BACKGROUND OF THE INVENTION

Induction heating is a rapid and easily controllable heating method for heating an electrically conducting metal or metal alloy workpiece, and can provide sufficient energy to melt the workpiece and maintain it in the molten state. An induction heating apparatus generally includes an inductor, such as an electrically conductive copper coil, that surrounds the workpiece. When the inductor is subjected to a varying electromagnetic field, a varying current is generated within the inductor, which induces an electromotive force in the workpiece. The induced electromotive force results in the generation of an electric current in the workpiece, and the internal resistance to the current in the workpiece heats the workpiece.

An example of a coil-type induction heating apparatus is described in U.S. Pat. No. 5,588,019 to Ruffini et al. entitled "High Performance Induction Melting Coil," which issued on Dec. 24, 1996. The induction-melting coil surrounds a crucible for holding the workpiece. Magnetic flux concentrators that are fabricated from a low reluctance composition are placed around the induction coil. These flux concentrators concentrate the magnetic flux generated by the current carrying induction melting coil at the workpiece. This allows the workpiece to be heated efficiently since less current is required to heat and melt the workpiece than by using just the induction coil. For a workpiece having a complex shape, flux concentrators can direct electromagnetic field energy to areas of the workpiece that are inaccessible to just the induction coil. Flux concentrators also minimize the inductive heating of other components of the apparatus. The induction heating apparatus is also provided with a cooling system to cool the flux concentrators since they are known to lose permeability when heated to high temperatures.

Various methods for making magnetic flux concentrators are known. For example, U.S. Pat. No. 4,776,980 to R. S. Ruffini entitled "Inductor Insert Compositions and Methods," which issued on Oct. 11, 1988, describes compositions used to make inductor inserts, i.e. magnetic flux concentrators. A high purity, disk shaped, annealed, iron powder is treated with phosphoric acid. This treatment provides electrical insulation between the iron particles of the powder, which reduces electrical current, known as "eddy currents" between the iron particles. This results in a reduction in heat generated in the flux concentrators during operation. The treated iron powder is mixed with a polymeric resin binder, and a mold release agent may also be added. The mixture is dried to a powder and pressed in a die to form a body. The body is cured at 150–500° F., and then sanded to produce the magnetic flux concentrator.

Another method for making magnetic flux concentrators is described in U.S. Pat. No. 5,828,940 to T. J. Learman entitled "Formable Composite Magnetic Flux Concentrator and Method of Making the Concentrator," which issued on Oct. 27, 1998. A putty containing electrolytic iron powder, carbonyl iron powder, a binder, and catalysts is prepared. The putty is vibrated under compression to remove air, molded into a body, embedded with hollow elements, and heated to harden the body and produce the magnetic flux concentrator. The hollow elements are a part of a heat removal system to cool the flux concentrator during operation.

Generally, magnetic flux concentrators are provided with a cooling system to remove heat from the concentrators during operation because excessive heat may lead to decomposition of the polymeric binders and to a reduction in the permeability of the magnetic flux concentrator. Clearly, magnetic flux concentrators that can be operated at elevated temperatures without losing substantial permeability are highly desirable.

Therefore, an object of the present invention is a process for making iron-carbon compacts that can be used as, or fabricated into, magnetic flux concentrators.

Another object of the present invention is a process for making magnetic flux concentrators that maintain an operational permeability at temperatures higher than those for conventional flux concentrators containing polymeric resin binders.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention as embodied and broadly described herein, the invention includes a process for making iron-carbon compacts. The process includes the steps of preparing a slurry of iron powder, furfuryl alcohol, and a catalyst that initiates the polymerization of furfuryl alcohol into a resin. The slurry is heated to promote the conversion of the furfuryl alcohol into the resin so that a powder mixture containing iron powder and resin is produced. The resin-containing powder is pressed to form a green body, and the green body is heated to form the iron-carbon compact.

DETAILED DESCRIPTION OF THE INVENTION

Briefly, the present invention includes a process for making iron-carbon compacts that can be used as, or machined into, magnetic flux concentrators for an induction heating apparatus. To fabricate compacts of the present invention, a slurry of iron powder, furfuryl alcohol, and a catalyst that initiates the polymerization of furfuryl alcohol into a resin is prepared. The slurry is stirred and heated to promote the conversion of the furfuryl alcohol into a dry resin, and the resulting resin-containing powder is placed into a die and pressed to form a green body. The green body is removed from the die, placed into furnace under an inert gas atmosphere, and heated. Upon cooling, the resulting iron carbon compact can be used as, or machined into, a magnetic flux concentrator that can be heated to temperatures up to about 450° C. without a significant reduction in permeability.

The slurry was heated with a heat lamp. Preferably, heating devices that also provide magnetic stirring to the slurry are especially convenient. Some of the furfuryl alcohol evaporates from the slurry during heating.

The iron powder used with the present invention comprises about 100–60% electrolytic iron powder and about 0–40% carbonyl iron powder. A mixture containing about 15% carbonyl iron powder and 85% electrolytic iron powder is preferable. The electrolytic iron powder used with the present invention was treated with phosphoric acid to provide an electrically insulating coating to the powder, which minimizes eddy currents in the iron-carbon compact and reduces the amount of heat generated in the compact during operation. The electrolytic iron powder used was a highly pure, irregular-shaped, 100-mesh size powder with an average particle size of about 20 microns. The carbonyl iron powder was spherical-shaped and an average particle size of about 1.5–7 microns. The combination of electrolytic iron powder and carbonyl iron provides the resulting iron carbon compact with a higher packing density than a compact derived solely from electrolytic powder.

A wide variety of polymerization catalysts can be used with the present invention. These include Bronstead acids such as the mineral acids sulfuric acid and hydrochloric acid, and Lewis acids such as zirconyl nitrate and uranyl nitrate. Maleic anhydride is a preferred polymerization catalyst.

The temperature of the furnace was controlled as the green body was converted into the iron-carbon compact. The green body was heated from about 20° C. to about 275° C. over a time period of about 16 hours and then maintained at 275° C. for about 1 hour. The furnace was then flushed with argon to prevent the oxidation of the compact. The temperature was increased to about 525° C. over a time period of about 18 hours and then maintained at 525° C. for about 4 hours, after which the furnace was cooled and the iron-carbon compact was obtained. During the heating period between about 20° C. to about 275° C., water vapor was released from the polymer products of the furfuryl alcohol. Importantly, the green body should be heated evenly and slowly enough during this period so that this evolution of vapor does not result in the production of cracks in the body. During the heating stage between about 275° C. to about 525° C., the resin dehydrates further and decomposes into carbon.

The maximum temperature attained during the heating cycle had a dramatic effect on the permeability of the resulting iron carbon compact. If the maximum temperature during the heating cycle was too high, the resulting iron carbon compact had too low a permeability for use as a magnetic flux concentrator. For example, the following heating cycle resulted in an iron carbon compact with too low a permeability: a green body of the present invention was heated from about 20° C. to about 250° C. over about 16 hours. The temperature was maintained at 250° C. for about 2 hours. The temperature was then raised to about 900° C. over about 12 hours and maintained at 900° C. for about 2 hours. After cooling to room temperature, the resulting iron carbon-compact had a permeability of less than 1, which was too low for the compact to be used as a magnetic flux concentrator.

A cylindrical hardened steel die was used to form the green body. The die should be able to apply and withstand a pressure of about 20–50 tons/in$^2$ so that a dense green body can be formed. The shape of the die is generally chosen to provide an iron-carbon compact having the shape of the desired magnetic flux concentrator. For example, a torroidal-shaped die is used if a torroidal-shaped flux concentrator is desired. The iron carbon compacts of the present invention can also be sanded, cut, drilled, or otherwise machined in order to provide a magnetic flux concentrator having a desired shape.

The iron-carbon compact resulting of the present invention should contain the same amount of iron as was in the slurry. The remaining portion of the compact is carbon produced from carbonization of the resin.

EXAMPLE

Electrolytic iron powder (375 g), which had been treated with phosphoric acid, was blended with carbonyl iron powder (28 g). A solution of furfuryl alcohol (50 cc) and maleic anhydride (4 g) was prepared, and was added to the iron powder blend to produce a slurry. The slurry was stirred and heated with a heat lamp to produce a dry powder, which was loaded into a cylindrical hardened steel die and pressed at about 36 tons/in$^2$. The resulting green body was ejected from the die and heated under an atmosphere of argon in a furnace. The green body was heated from a temperature of about 20° C. to about 275° C. in a time period of about 16 hours. The temperature was maintained at 275° C. for about 1 hour, after which the temperature was raised to about 525° C. over a time period of about 18 hours. The temperature was maintained at 525° C. for about 4 hours. The furnace was cooled, and an iron-carbon compact having a permeability of about 44 was obtained.

The above example of the present invention has been presented for purposes of illustration and description and is not intended to be exhaustive or to limit the invention to the precise form disclosed, and obviously many modifications and variations are possible in light of the above teaching. The embodiment was chosen and described in order to best explain the principles of the invention and its practical application to is thereby enable others skilled in the art to best utilize the invention in various embodiments and with various modifications as are suited to the particular use contemplated. It is intended that the scope of the invention be defined by the claims appended hereto.

What is claimed is:

1. A process for making an iron-carbon compact, comprising the steps of:

a. preparing a slurry of iron powder, furfuryl alcohol, and a catalyst that initiates the polymerization of the furfuryl alcohol into a resin, b. heating the slurry to promote the conversion of the furfuryl alcohol into the resin so that a powder mixture containing iron powder and resin is produced, c. pressing the resin-containing powder mixture into a green body; and d. heating the green body to carbonize the resin and form the iron-carbon compact.

2. The process for making an iron-carbon compact of claim 1, wherein the iron powder comprises about 0–40% carbonyl iron powder and about 100–60% electrolytic iron powder.

3. The process for making an iron-carbon compact of claim 2, wherein the electrolytic iron powder is treated with phosphoric acid.

4. The process for making an iron-carbon compact of claim 3, wherein the polymerization catalyst is selected from the group consisting of mineral acids and Lewis acids.

5. The process for making an iron-carbon compact of claim 4, wherein the resin-containing powder is pressed at about 20–50 tons/in$^2$ to form the green body.

6. The process for making an iron-carbon compact of claim 5, wherein said step of heating the green body includes heating the green body from about 20° C. to about 275° C. over a time period of about 16 hours and maintaining the temperature at about 275° C. for about 1 hour, then increasing the temperature to about 525° C over a time period of about 18 hours and maintaining the temperature of about 525° C. for about 4 hours.

7. The process for making an iron-carbon compact of claim 6, wherein the green body is heated in an inert gas atmosphere.

8. The process for making an iron-carbon compact of claim 7, wherein the inert gas atmosphere comprises argon.

9. The process for making an iron-carbon compact of claim 8, wherein the electrolytic iron powder is a 100 mesh powder having an average particle size of about 20 microns.

10. The process for making an iron-carbon compact of claim 9, wherein the carbonyl iron powder has an average particle size of about 1.5–7 microns.

11. The process for making an iron-carbon compact of claim 10, wherein the polymerization catalyst is maleic anhydride.

12. The process for making an iron-carbon compact of claim 11, wherein the resin-containing powder is pressed into a green body at a pressure of about 36 tons/in$^2$.

13. The process for making an iron-carbon compact of claim 12, wherein the iron powder includes about 7% carbonyl iron powder and about 93% electrolytic iron powder.

14. An iron-carbon compact, made by the process comprising the steps of:

a. preparing a slurry of iron powder, furfuryl alcohol, and a catalyst that initiates the polymerization of the furfuryl alcohol, b. heating the slurry to promote the conversion of the furfuryl alcohol into a resin, whereby a powder mixture containing iron powder and resin is produced, c. pressing the resin-containing powder mixture into a green body; and d. heating the green body to carbonize the resin and form the iron-carbon compact.

15. The iron-carbon compact of claim 14, wherein the iron powder comprises about 0–40% carbonyl iron powder and about 100–60% electrolytic iron powder.

16. The iron-carbon compact of claim 15, wherein the electrolytic iron powder is treated with phosphoric acid.

17. The iron-carbon compact of claim 16, wherein the catalyst is selected from the group consisting of mineral acids and Lewis acids.

18. The iron-carbon compact of claim 17, wherein the resin-containing powder is pressed at about 20–50 tons/in$^2$ to form the green body.

19. The iron-carbon compact of claim 18, wherein said step of heating the green body includes heating the green body from about 20° C. to about 275° C. over a time period of about 16 hours and then maintaining the temperature of about 275° C. for about 1 hour, then increasing the temperature to about 525° C. over a time period of about 18 hours and then maintaining the temperature of about 525° C. for about 4 hours.

20. The iron-carbon compact of claim 19, wherein the green body is heated in an inert gas atmosphere.

21. The iron-carbon compact of claim 20, wherein the inert gas atmosphere comprises argon.

22. The iron-carbon compact of claim 21, wherein the electrolytic powder is a 100 mesh powder having an average particle size of about 20 microns.

23. The process of claim 22, wherein the carbonyl iron powder has an average particle size of about 1.5–7 microns.

24. The process of claim 23, wherein the polymerization catalyst is maleic anhydride.

25. The iron-carbon compact of claim 24, wherein the resin-containing powder is pressed into a green body at a pressure of about 36 tons/in$^2$.

26. The iron-carbon compact of claim 25, wherein the iron powder includes about 7% carbonyl iron powder and about 93% electrolytic iron powder.

27. A process for making a magnetic flux concentrator, comprising the steps of:

a. preparing a slurry of iron powder, furfuryl alcohol, and a catalyst that initiates the polymerization of the furfuryl alcohol into a resin, b. heating the slurry to promote the conversion of the furfuryl alcohol into the resin so that a powder mixture containing iron powder and resin is produced, c. pressing the resin-containing powder mixture into a green body; and d. heating the green body to carbonize the resin and form the magnetic flux concentrator.

28. The process for making a magnetic flux concentrator of claim 27, wherein the iron powder comprises about 0–40% carbonyl iron powder and about 100–60% electrolytic iron powder.

29. The process for making a magnetic flux concentrator of claim 28, wherein the electrolytic iron powder is treated with phosphoric acid.

30. The process for making a magnetic flux concentrator of claim 29, wherein the polymerization catalyst is selected from the group consisting of mineral acids and Lewis acids.

31. The process for making a magnetic flux concentrator of claim 30, wherein the resin-containing powder is pressed at about 20–50 tons/in$^2$ to form the green body.

32. The process for making a magnetic flux concentrator of claim 31, wherein said step of heating the green body includes heating the green body from about 20° C. to about 275° C. over a time period of about 16 hours and maintaining the temperature at about 275° C. for about 1 hour, then increasing the temperature to about 525° C. over a time period of about 18 hours and maintaining the temperature of about 525° C. for about 4 hours.

33. The process for making a magnetic flux concentrator of claim 32, wherein the green body is heated in an inert gas atmosphere.

34. The process for making a magnetic flux concentrator of claim 33, wherein the inert gas atmosphere comprises argon.

35. The process for making a magnetic flux concentrator of claim 34, wherein the electrolytic iron powder is a 100 mesh powder having an average particle size of about 20 microns.

36. The process for making a magnetic flux concentrator of claim 35, wherein the carbonyl iron powder has an average particle size of about 1.5–7 microns.

37. The process for making a making a magnetic flux concentrator of claim 36, wherein the polymerization catalyst is maleic anhydride.

38. The process for making a magnetic flux concentrator s of claim 37, wherein the resin-containing powder is pressed into a green body at a pressure of about 36 tons/in$^2$.

39. The process for making a magnetic flux concentrator of claim 38, wherein the iron powder includes about 7% carbonyl iron powder and about 93% electrolytic iron powder.

40. A magnetic flux concentrator, made by the process comprising the steps of:

a. preparing a slurry of iron powder, furfuryl alcohol, and a catalyst that initiates the polymerization of the furfuryl alcohol, b. heating the slurry to promote the conversion of the furfuryl alcohol into a resin, whereby a powder mixture containing iron powder and resin is produced, c. pressing the resin-containing powder mixture into a green body; and d. heating the green body to carbonize the resin and form the magnetic flux concentrator.

41. The magnetic flux concentrator of claim 40, wherein the iron powder comprises about 0–40% carbonyl iron powder and about 100–60% electrolytic iron powder.

42. The magnetic flux concentrator of claim 41, wherein the electrolytic iron powder is treated with phosphoric acid.

43. The magnetic flux concentrator of claim 42, wherein the catalyst is selected from the group consisting of mineral acids and Lewis acids.

44. The magnetic flux concentrator of claim 43, wherein the resin-containing powder is pressed at about 20–50 tons/in$^2$ to form the green body.

45. The magnetic flux concentrator of claim 44, wherein said step of heating the green body includes heating the green body from about 20° C. to about 275° C. over a time period of about 16 hours and then maintaining the temperature of about 275° C. for about 1 hour, then increasing the temperature to about 525° C. over a time period of about 18 hours and then maintaining the temperature of about 525° C. for about 4 hours.

46. The magnetic flux concentrator of claim 45, wherein the green body is heated in an inert gas atmosphere.

47. The magnetic flux concentrator of claim 46, wherein the inert gas atmosphere comprises argon.

48. The magnetic flux concentrator of claim 47, wherein the electrolytic powder is a 100 mesh powder having an average particle size of about 20 microns.

49. The magnetic flux concentrator of claim 48, wherein the carbonyl iron powder has an average particle size of about 1.5–7 microns.

50. The magnetic flux concentrator of claim 49, wherein the polymerization catalyst is maleic anhydride.

51. The magnetic flux concentrator of claim 50, wherein the resin-containing powder is pressed into a green body at a pressure of about 36 tons/in$^2$.

52. The magnetic flux concentrator of claim 51, wherein the iron powder includes about 7% carbonyl iron powder and about 93% electrolytic iron powder.

* * * * *